US008966771B2

(12) United States Patent
Chu et al.

(10) Patent No.: US 8,966,771 B2
(45) Date of Patent: Mar. 3, 2015

(54) OUT OF FRONT KNIFE WITH ASSISTED OPENING MECHANISM

(71) Applicants: Jitung Chu, New Taipei (TW); Jiun-Yu Chu, New Taipei (TW)

(72) Inventors: Jitung Chu, New Taipei (TW); Jiun-Yu Chu, New Taipei (TW)

( * ) Notice: Subject to any disclaimer, the term of this patent is extended or adjusted under 35 U.S.C. 154(b) by 291 days.

(21) Appl. No.: 13/726,393

(22) Filed: Dec. 24, 2012

(65) Prior Publication Data

US 2014/0173911 A1 Jun. 26, 2014

(51) Int. Cl.
*B26B 1/08* (2006.01)

(52) U.S. Cl.
CPC ..... *B26B 1/08* (2013.01)
USPC ..... 30/162

(58) Field of Classification Search
CPC ..... B26B 1/08; B26B 1/00; B26B 1/02; B26B 1/04; B26B 1/06
USPC ..... 30/159–164, 151, 153, 329, 335–339
See application file for complete search history.

(56) References Cited

U.S. PATENT DOCUMENTS

2009/0235534 A1* 9/2009 Chu ..... 30/162
2013/0174423 A1* 7/2013 Liao ..... 30/162

* cited by examiner

*Primary Examiner* — Ned Landrum
*Assistant Examiner* — Evan Macfarlane
(74) *Attorney, Agent, or Firm* — Rabin & Berdo, P.C.

(57) ABSTRACT

An out of front knife with an assisted opening mechanism has a handle, a blade mounted in the handle, a thumb stud that drives the blade, and an extending assembly that assists with extending the blade out of the handle. With two sliders and two springs of the extending assembly, only when the blade is intentionally pushed to move a preset distance and overcome a preset resistance, one of the springs pulls and assists the blade of the out of front knife to extend out of the handle. Therefore, the out of front knife with the assisted opening mechanism is used safely.

14 Claims, 8 Drawing Sheets

OUT OF FRONT KNIFE WITH ASSISTED OPENING MECHANISM

BACKGROUND OF THE INVENTION

1. Field of the Invention

The present invention relates to an out of front knife with an assisted opening mechanism, especially to an out of front knife that has a blade that must be moved manually a preset distance and overcome a preset resistance, such that a spring inside the out of front knife will help the blade to move to be extended out.

2. Description of the Prior Art(s)

An out of front knife has a handle and a blade that is able to slide directly forward to extend out of the handle. The out of front knife has existed and long been popular among general republic due to its portability and user friendly design. A conventional out of front knife further has a spring mechanism and a locking mechanism. The spring mechanism is connected to the handle and the blade, and is able to pull the blade to assist the blade to extend out of the handle. The locking mechanism locks the blade at an open position or a closed position, and prevents the blade from being retracted or extended accidentally.

However, once the locking mechanism does not lock the blade well, the spring mechanism is very likely to automatically pull the blade to quickly extend out of the handle and injure people when the conventional out of front knife is bumped or any other accident happens. Therefore, the conventional out of front knife is dangerous and in some countries is regulated by laws and restricted to registered users only.

To overcome the shortcomings, the present invention provides an out of front knife with an assisted opening mechanism to mitigate or obviate the aforementioned problems.

SUMMARY OF THE INVENTION

The main objective of the present invention is to provide an out of front knife with an assisted opening mechanism. The out of front knife has a handle, a blade mounted in the handle, a thumb stud that drives the blade, and an extending assembly that assists with extending the blade out of the handle.

With two sliders and two springs of the extending assembly, only when the blade is intentionally pushed to move a preset distance and overcome a preset resistance, one of the springs pulls and assists the blade of the out of front knife to extend out of the handle. Therefore, the out of front knife with the assisted opening mechanism is used safely.

Other objectives, advantages and novel features of the invention will become more apparent from the following detailed description when taken in conjunction with the accompanying drawings.

DETAILED DESCRIPTION OF THE PREFERRED EMBODIMENT(S)

Figure 1:
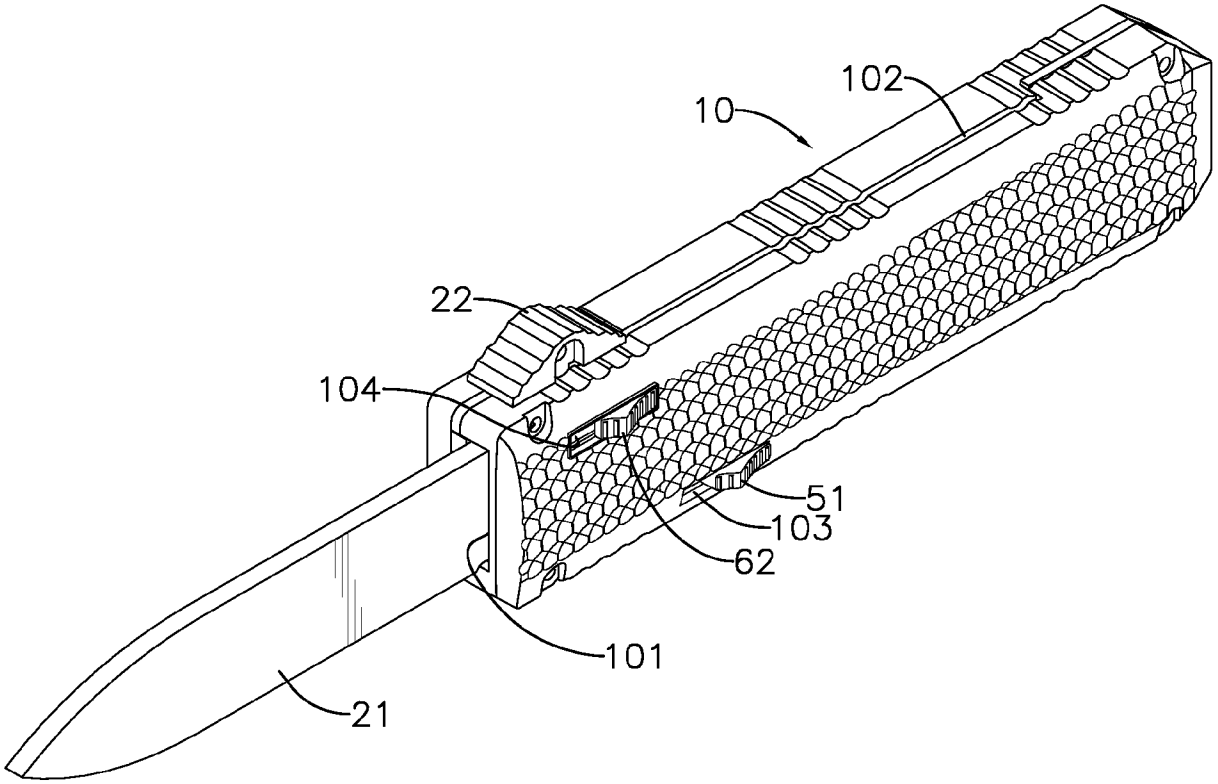
FIG. 1 is a perspective view of an out of front knife with an assisted opening mechanism in accordance with the present invention.
Figure 2:
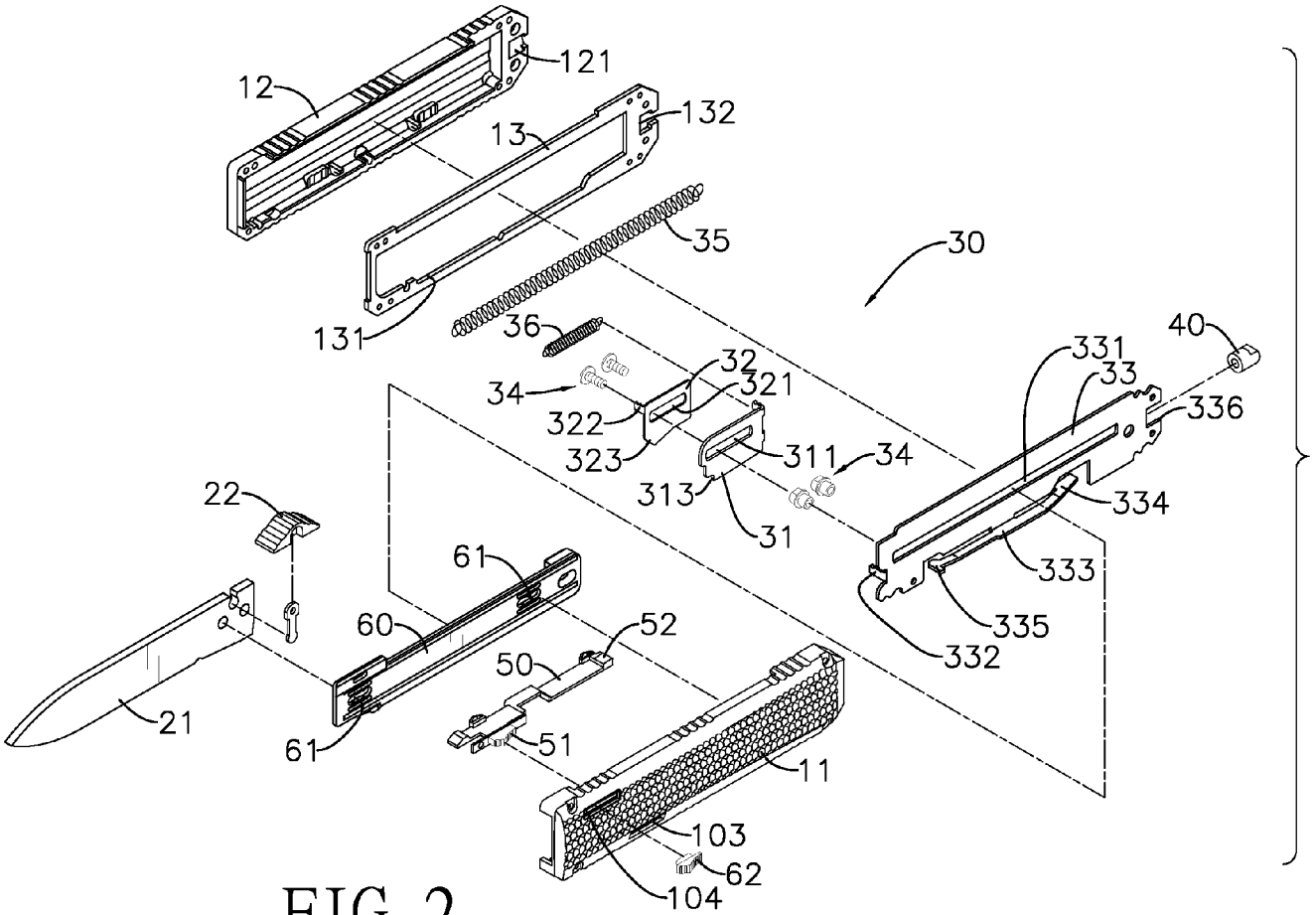
FIG. 2 is an exploded perspective view of the out of front knife in FIG. 1.

With reference to FIGS. 1 and 2, an out of front knife with an assisted opening mechanism in accordance with the present invention comprises a handle 10, a blade 21, a thumb stud 22, an extending assembly 30, an engaging member 40, a retainer 50 and an unlock panel 60.

Figure 3:
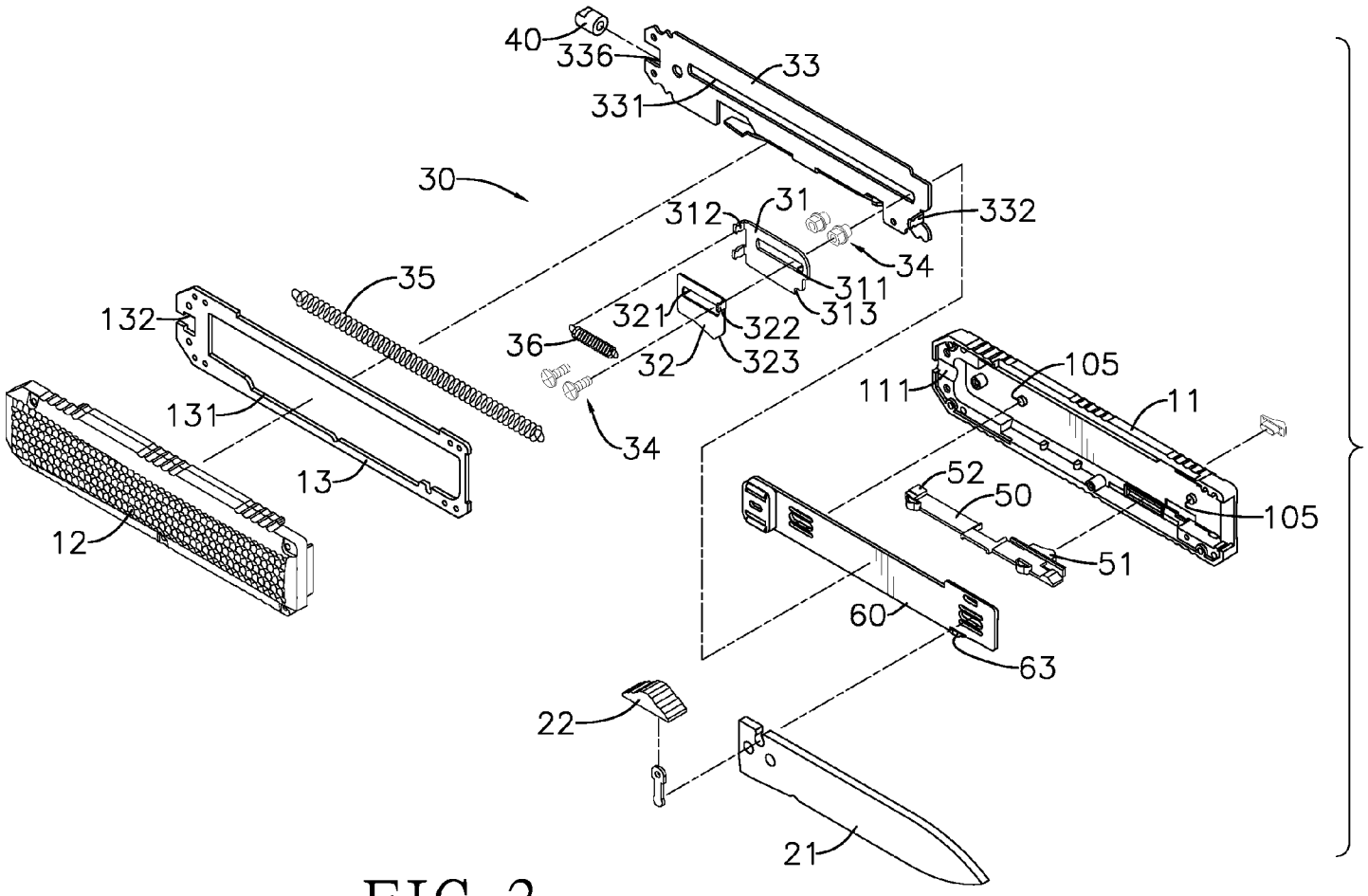
FIG. 3 is another exploded perspective view of the out of front knife in FIG. 1.

With further reference to FIG. 3, the handle 10 has a rear closed end, a front opening end 101, a sidewall, a front wall (a wide wall), an inner surface, a sliding slot 102, a first through hole 103, a second through hole 104 and at least one guiding protrusion 105. The sliding slot 102 of the handle 10 is formed through the sidewall of the handle 10 and has two ends respectively extending toward the rear closed end and the front opening end 101 of the handle 10. The first through hole 103 and the second through hole 104 are separately formed through the front wall of the handle 10. Each of the first and the second through holes 103, 104 has two ends respectively extending toward the rear closed end and the front opening end 101 of the handle 10. The at least one guiding protrusion 105 is formed on the inner surface of the handle 10.

In the preferred embodiment of the present invention, the handle 10 is formed from a front casing 11, a rear casing 12 and a guiding panel 13. The first through hole 103, the second through hole 104 and the sliding slot 102 of the handle 10 are formed through the front casing 11. The at least one guiding protrusion 105 of the handle 10 is formed on an inner surface of the front casing 11. The front casing 11 further has a mounting recess 111 formed in a rear end of the front casing 11. The rear casing 12 corresponds to and is securely mounted on the front casing 11 and has a mounting recess 121 formed in a rear end of the rear casing 12 and corresponding to the mounting recess 111 of the front casing 11. The guiding panel 13 is held between the front casing 11 and the rear casing 12 and has a guiding slot 131 and an engaging recess 132. The guiding slot 131 of the guiding panel 13 is formed through the guiding panel 13. The engaging recess 132 of the guiding panel 13 is formed in a rear end of the guiding panel 13 and corresponds to the mounting recesses 111, 121 of the front casing 11 and the rear casing 12.

The blade 21 is slidably mounted through the front opening end 101 of the handle 10 and has an inner end protruding in the handle 10. The thumb stud 22 is mounted beside the handle 10, protrudes through the sliding slot 102 of the handle 10 and is securely connected to the blade 21. When the thumb stud 22 is pushed, the thumb stud 22 and the blade 21 move along the sliding slot 102 of the handle 10 simultaneously.

The extending assembly 30 is mounted in the handle 10 and has a positioning frame 33, a first slider 31, a second slider 32, at least one fastener 34, an extending spring 35 and a retracting spring 36.

The positioning frame 33 is securely mounted in the handle 10, is held between the front casing 11 and the guiding panel 13, and has a front end, a rear end, a side edge, a sliding slot 331, a connecting protrusion 332, a resilient rod 333 and a mounting recess 336. The sliding slot 331 of the positioning frame 33 is formed through the positioning frame 33 and has two ends respectively extending toward the rear closed end and the front opening end 101 of the handle 10. The connecting protrusion 332 is disposed on the front end of the positioning frame 33. The resilient rod 333 is disposed on the side edge of the positioning frame 33 and has a retracting limiting end 334 and an extending limiting end 335. The retracting limiting end 334 corresponds to the rear closed end of the handle 10. The extending limiting end 335 corresponds to the front opening end 101 of the handle 10. The mounting recess 336 of the positioning frame 33 is formed in the rear end of the positioning frame 33 and corresponds to the engaging recess 132 of the guiding panel 13 and the mounting recesses 111, 121 of the front casing 11 and the rear casing 12.

The first slider 31 is disposed beside the positioning frame 33 and has a front end, a rear end, a sliding slot 311, two connecting protrusions 312 and an abutting portion 313. The sliding slot 311 of the first slider 31 is formed through the first slider 31, corresponds to the sliding slot 331 of the positioning frame 33, and has two ends respectively extending toward the rear end of the first slider 31 and the front end of the first slider 31. The connecting protrusions 312 of the first slider 31 are separately disposed on the rear end of the first slider 31. The abutting portion 313 is formed on the front end of the first slider 31.

The second slider 32 is disposed beside the first slider 31 and has a front end, a rear end, a sliding slot 321, a connecting protrusion 322 and a pushing portion 323. The sliding slot 321 of the second slider 32 is formed through the second slider 32, corresponds to and is shorter than the sliding slot 311 of the first slider 31, and has two ends respectively extending toward the rear end of the second slider 32 and the front end of the second slider 32. The connecting protrusion 322 of the second slider 32 is disposed on the front end of the second slider 32. The pushing portion 323 is formed on the front end of the second slider 32.

The at least one fastener 34 is mounted through the sliding slots 321, 311, 331 of the second slider 32, the first slider 31 and the positioning frame 33 and is securely attached to the inner end of the blade 21. Thus, as the blade 21 moves, the first slider 31 and the second slider 32 move along the sliding slot 331 of the positioning frame 33 simultaneously.

The extending spring 35 is a tension spring and has two ends respectively connected to the connecting protrusion 332 of the positioning frame 33 and one of the connecting protrusions 312 of the first slider 31. The retracting spring 36 is a compression spring and has two ends respectively connected to the other one of the connecting portions 312 of the first slider 31 and the connecting protrusion 322 of the second slider 32.

The engaging member 40 is mounted through the mounting recesses 111, 121, 336 of the front casing 11, the rear casing 12 and the positioning frame 33, and engages the engaging recess 132 of the guiding panel 13 to hold the guiding panel 13 and the positioning frame 33 firmly in the handle 10.

The retainer 50 is mounted in the handle 10, is disposed beside the resilient rod 333 of the positioning frame 33 and has a switch button 51 and a pressing protrusion 52. The switch button 51 of the retainer 50 is mounted through the first through hole 103 of the handle 10 and protrudes out of the handle 10 to allow the retainer 50 to be moved. The pressing protrusion 52 corresponds to the retracting limiting end 334 of the resilient rod 333 and selectively presses against the retracting limiting end 334.

The unlock panel 60 is slidably mounted in the handle 10, is disposed between the blade 21 and the front casing 11, and has at least one guiding slot 61, a switch button 62 and a pushing protrusion 63. The at least one guiding slot 61 of the unlock panel 60 is formed through the unlock panel 60. Each of the at least one guiding slot 61 of the unlock panel 60 is mounted around a corresponding one of the at least one guiding protrusion 105 of the handle 10 and has two ends respectively extending toward the rear closed end and the front opening end 101 of the handle 10. Thus, the unlock panel 60 slides relative to the handle 10 along a specific direction. The switch button 62 of the unlock panel 60 is mounted through the second through hole 104 of the handle 10 and protrudes out of the handle 10 to allow the unlock panel 60 to be moved. The pushing protrusion 63 corresponds to the extending limiting end 335 of the resilient rod 333 and selectively pushes the extending limiting end 335.

Figure 4:
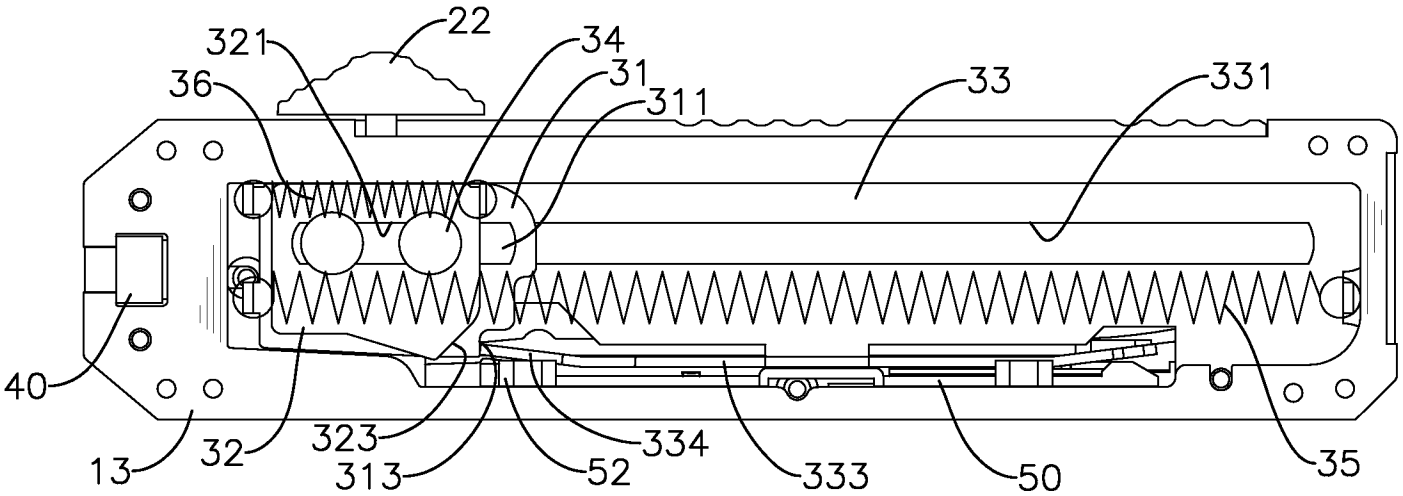
FIG. 4 is an operational side view of the out of front knife in FIG. 1, showing a blade is retraced in a handle and a pressing protrusion of a retainer presses against a retracting limiting end of a resilient rod.

With reference to FIG. 4, when the blade 21 of the out of front knife is retracted in the handle 10, the retracting limiting end 334 of the resilient rod 333 abuts the abutting portion 313 of the first slider 31. Furthermore, the retainer 50 is switched to allow the pressing protrusion 52 to press against the retracting limiting end 334 of the resilient rod 333 and to ensure that the retracting limiting end 334 of the resilient rod 333 does not leave the abutting portion 313 of the first slider 31. Consequently, the blade 21 does not accidently extend out of the handle 10.

Figure 5:
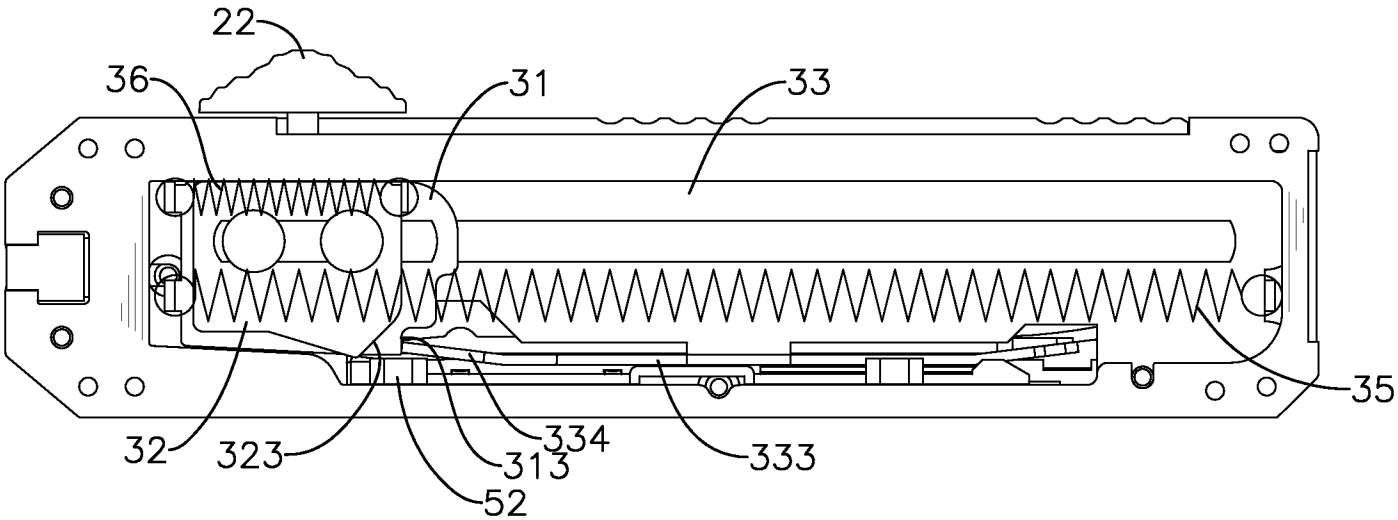
FIG. 5 is an operational side view of the out of front knife in FIG. 1, showing the blade is retraced in the handle and the pressing protrusion of the retainer is away from the retracting limiting end of the resilient rod.
Figure 6:
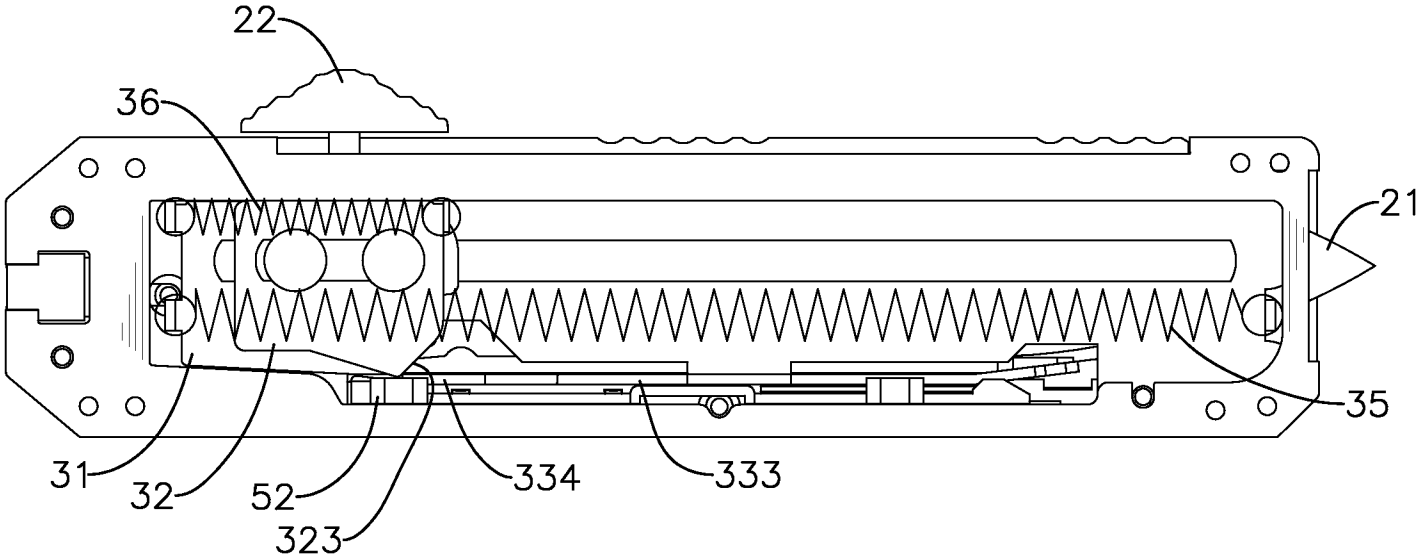
FIG. 6 is an operational side view of the out of front knife in FIG. 1, showing the blade is partially extended.

With further reference to FIGS. 5 and 6, when the retainer 50 is switched and the pressing protrusion 52 of the retainer 50 is away from the retracting limiting end 334 of the resilient rod 333, the thumb stud 22 as well as the blade 21 is capable of being pushed to move toward the front opening end 101 of the handle 10. Moreover, the second slider 32 also moves together with the blade 21 and the thumb stud 22 via the at least one fastener 34 for a short distance. Until the pushing portion 323 of the second slider 32 pushes the retracting limiting end 334 of the resilient rod 333 away from the abutting portion 313 of the first slider 31, the extending spring 35 pulls the first slider 31, the second slider 32 and the blade 21 to move toward the front opening end 101 of the handle 10. Thus, the blade 21 is assisted to be extended out of the handle 10.

When the thumb stud 22 and the blade 21 are pushed, the second slider 32 is driven and the retracting spring 36 is compressed first, and then the first slider 31 is moved via the at least one fastener 34 later. If a force applied to the thumb stud 22 and the blade 21 is unable to allow the pushing portion 323 of the second slider 32 to push the retracting limiting end 334 of the resilient rod 333 to depart from the abutting portion 313 of the first slider 31, the retracting spring 36 pulls the second slider 32, the blade 21 and the thumb stud 22 back to a retracting position. If the thumb stud 22 is just bumped by accident rather than intentionally pushed to drive the blade 21 to push the retracting limiting end 334 of the resilient rod 333, the blade 21 is not extended out. Therefore, the out of front knife in accordance with the present invention can be used safely.

Figure 7:
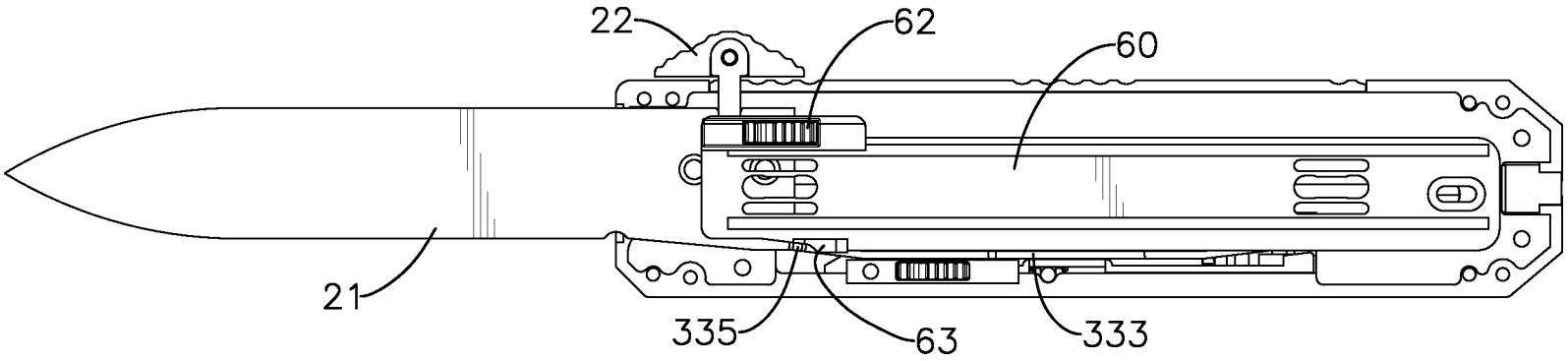
FIG. 7 is an operational side view of the out of front knife in FIG. 1, showing the blade is extended and an extending limiting end of the resilient rod abuts an inner end of the blade.

With reference to FIG. 7, after the extending spring 35 pulls the blade 21 to fully extend the blade 21 of the handle 10, the extending limiting end 335 of the resilient rod 333 abuts the inner end of the blade 21. Thus, the blade 21 would not be retracted into the handle 10 by any unexpected force.

Figure 8:
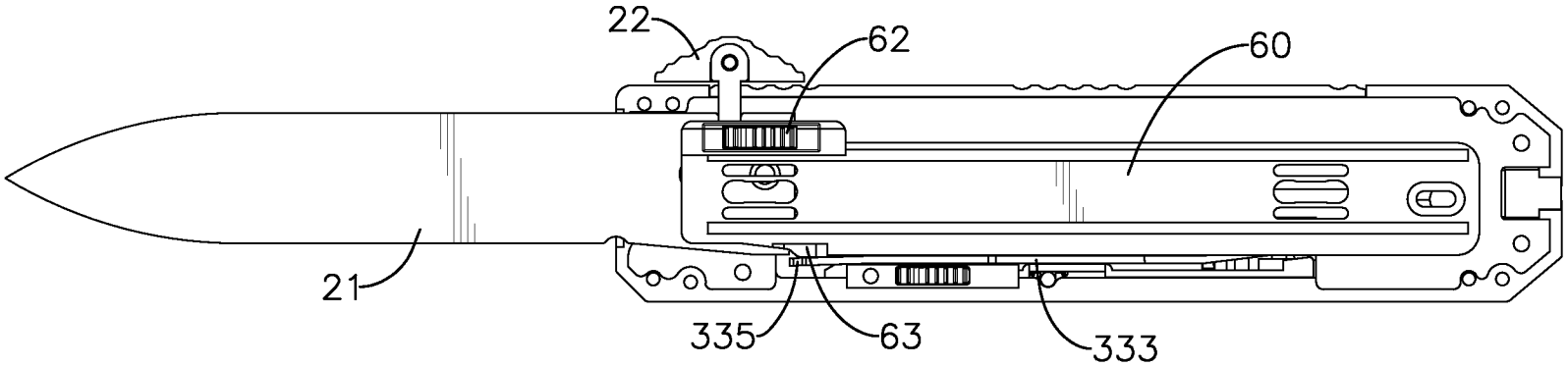
FIG. 8 is an operational side view of the out of front knife in FIG. 1, showing the blade is extended and the extending limiting end of the resilient rod is away from the inner end of the blade.

With further reference to FIG. 8, when the unlock panel 60 is switched to allow the pushing protrusion 63 of the unlock panel 60 to push the extending limiting end 335 of the resilient rod 333 away from the inner end of the blade 21, the thumb stud 22, the blade 21, the first slider 31 and the second slider 32 can be pushed to move toward the rear closed end of the handle 10 to retract the blade 21 into the handle 10. Until the retracting limiting end 334 of the resilient rod 333 abuts the abutting portion 313 of the first slider 31, the blade 21 is securely held in the handle 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An out of front knife with an assisted opening mechanism comprising:

a handle having a rear closed end, a front opening end, and a sliding slot formed through a sidewall of the handle;

a blade slidably mounted through the front opening end of the handle;

a thumb stud mounted beside the handle, protruding through the sliding slot of the handle and securely connected to the blade; and an extending assembly mounted in the handle and having a positioning frame securely mounted in the handle and having a sliding slot formed through the positioning frame; and a resilient rod disposed on a side edge of the positioning frame and having a retracting limiting end positioned toward the rear closed end of the handle;

a first slider disposed beside the positioning frame and having a sliding slot formed through the first slider and aligned with the sliding slot of the positioning frame; and an abutting portion formed on a front end of the first slider;

a second slider disposed beside the first slider and having a sliding slot formed through the second slider and aligned with the sliding slot of the first slider; and a pushing portion formed on a front end of the second slider;

at least one fastener mounted through the sliding slots of the second slider, the first slider and the positioning frame and securely attached to a tang end of the blade;

an extending spring being a tension spring and having two ends respectively connected to a front end of the positioning frame and a rear end of the first slider; and a retracting spring being a compression spring and having two ends respectively connected to the rear end of the first slider and the front end of the second slider;

wherein when the blade is retracted in the handle, the retracting limiting end of the resilient rod abuts the abutting portion of the first slider.

2. The out of front knife as claimed in claim 1, wherein the handle further has a first through hole formed through a wide wall of the handle; and the out of front knife further comprises a retainer mounted in the handle, disposed beside the resilient rod of the positioning frame and having a switch button mounted through the first through hole of the handle and protruding out of the handle; and a pressing protrusion positioned adjacent to the retracting limiting end of the resilient rod and selectively pressing against the retracting limiting end.

3. The out of front knife as claimed in claim 1, wherein the handle further has a second through hole formed through a wide wall of the handle;

the resilient rod of the positioning frame further has an extending limiting end positioned toward the front opening end of the handle; and the out of front knife further comprises an unlock panel slidably mounted in the handle and having a switch button mounted through the second through hole of the handle and protruding out of the handle; and a pushing protrusion positioned adjacent to the extending limiting end of the resilient rod and selectively pushing the extending limiting end.

4. The out of front knife as claimed in claim 2, wherein the handle further has a second through hole formed through the wide wall of the handle;

the resilient rod of the positioning frame further has an extending limiting end positioned toward the front opening end of the handle; and the out of front knife further comprises an unlock panel slidably mounted in the handle and having a switch button mounted through the second through hole of the handle and protruding out of the handle; and a pushing protrusion positioned adjacent to the extending limiting end of the resilient rod and selectively pushing the extending limiting end.

5. The out of front knife as claimed in claim 4, wherein the handle further has at least one guiding protrusion formed on an inner surface of the handle; and the unlock panel further has at least one guiding slot formed through the unlock panel, and each of the at least one guiding slot of the unlock panel is mounted around a corresponding one of the at least one guiding protrusion of the handle.

6. The out of front knife as claimed in claim 1, wherein the sliding slot of the second slider is shorter than the sliding slot of the first slider.

7. The out of front knife as claimed in claim 2, wherein the sliding slot of the second slider is shorter than the sliding slot of the first slider.

8. The out of front knife as claimed in claim 3, wherein the sliding slot of the second slider is shorter than the sliding slot of the first slider.

9. The out of front knife as claimed in claim 4, wherein the sliding slot of the second slider is shorter than the sliding slot of the first slider.

10. The out of front knife as claimed in claim 5, wherein the sliding slot of the second slider is shorter than the sliding slot of the first slider.

11. The out of front knife as claimed in claim 5, wherein the handle is formed from a first casing and a second casing;

the first through hole, the second through hole and the sliding slot of the handle are formed through the first casing; and the at least one guiding protrusion of the handle is formed on an inner surface of the first casing.

12. The out of front knife as claimed in claim 11, wherein the handle further has a guiding panel held between the first casing and the second casing and having a guiding slot formed through the guiding panel.

13. The out of front knife as claimed in claim 12, wherein the first casing further has a mounting recess formed in a rear end of the first casing;

the second casing further has a mounting recess formed in a rear end of the second casing and in alignment with the mounting recess of the first casing;

the guiding panel further has an engaging recess formed in a rear end of the guiding panel and in alignment with the mounting recesses of the first casing and the second casing;

the positioning frame further has a mounting recess formed in a rear end of the positioning frame and in alignment with the engaging recess of the guiding panel and the mounting recesses of the first casing and the second casing; and the out of front knife further comprises an engaging member mounted through the mounting recesses of the first casing, the second casing and the positioning frame, and engaging the engaging recess of the guiding panel.

14. The out of front knife as claimed in claim 13, wherein the positioning frame further has a connecting protrusion disposed on the front end of the positioning frame;

the first slider further has two connecting protrusions separately disposed on the rear end of the first slider;

the second slider further has a connecting protrusion disposed on the front end of the second slider;

the two ends of the extending spring are respectively connected to the connecting protrusion of the positioning frame and one of the connecting protrusions of the first slider; and two ends of the retracting spring are respectively connected to the other one of the connecting portions of the first slider and the connecting protrusion of the second slider.

* * * * *